US007806291B2

(12) United States Patent
Anderson

(10) Patent No.: US 7,806,291 B2
(45) Date of Patent: Oct. 5, 2010

(54) CENTER-PULL DISPENSER FOR WEB MATERIAL

(75) Inventor: Stephen Anderson, King, NC (US)

(73) Assignee: Buckeye Technologies, Memphis, TN (US)

( * ) Notice: Subject to any disclaimer, the term of this patent is extended or adjusted under 35 U.S.C. 154(b) by 1037 days.

(21) Appl. No.: 11/389,496

(22) Filed: Mar. 24, 2006

(65) Prior Publication Data

US 2006/0261076 A1 Nov. 23, 2006

Related U.S. Application Data

(60) Provisional application No. 60/683,461, filed on May 19, 2005, provisional application No. 60/722,894, filed on Sep. 30, 2005.

(51) Int. Cl.
*A47K 10/24* (2006.01)

(52) U.S. Cl. ..... 221/33; 221/44; 221/45; 221/46; 221/62; 221/63

(58) Field of Classification Search ..... 221/1–312 C
See application file for complete search history.

(56) References Cited

U.S. PATENT DOCUMENTS

| | | | | |
|---|---|---|---|---|
| 3,986,479 | A * | 10/1976 | Bonk | 118/506 |
| 4,262,816 | A * | 4/1981 | Margulies | 221/46 |
| 4,651,895 | A * | 3/1987 | Niske et al. | 221/63 |
| 5,273,184 | A * | 12/1993 | Rizzuto | 221/303 |
| 5,765,718 | A * | 6/1998 | Grasso et al. | 221/62 |
| 6,145,782 | A * | 11/2000 | King et al. | 242/593 |
| 6,158,614 | A | 12/2000 | Haines et al. | |
| 6,189,730 | B1 * | 2/2001 | McClymonds | 221/46 |
| 6,328,252 | B1 * | 12/2001 | Neveu et al. | 242/593 |
| 6,510,964 | B2 | 1/2003 | Paukov et al. | |
| 6,592,001 | B2 * | 7/2003 | Lewis et al. | 221/33 |
| 7,275,655 | B2 * | 10/2007 | Duff | 221/41 |
| 2003/0122031 | A1 | 7/2003 | Tramontina et al. | |
| 2005/0045295 | A1 | 3/2005 | Goulet et al. | |

FOREIGN PATENT DOCUMENTS

| | | |
|---|---|---|
| DE | 4006987 | 9/1991 |
| EP | 0480848 | 4/1992 |
| EP | 1206919 | 5/2002 |
| GB | 1472366 | 5/1977 |
| JP | 2000273492 | 10/2000 |
| WO | WO-00/02475 | 1/2000 |

* cited by examiner

*Primary Examiner*—Gene Crawford
*Assistant Examiner*—Michael K Collins
(74) *Attorney, Agent, or Firm*—Baker Botts L.L.P.

(57) ABSTRACT

According to one exemplary embodiment of the present invention, a center-pull bottom feed dispenser includes a housing defining a compartment and including a center-pull bottom feed arrangement for dispensing a sheet material that is in the form of a roll of the sheet material. The sheet material can be a pre-moistened airlaid web. The dispenser also includes a tray that supports the airlaid web roll and includes an outlet opening through which the airlaid web is fed to be accessible to a user. The tray includes a moisture retaining feature that directs fluid from the pre-moistened air-laid web away from the outlet opening and toward an outer peripheral edge of the roll.

33 Claims, 5 Drawing Sheets

CENTER-PULL DISPENSER FOR WEB MATERIAL

CROSS-REFERENCE TO RELATED APPLICATIONS

The present application claims the benefit of U.S. patent application Ser. Nos. 60/683,461, filed May 19, 2005 and 60/722,894, filed Sep. 30, 2005, each of which is expressly incorporated by reference in its entirety.

TECHNICAL FIELD

The present invention relates to a dispenser for sheet material, and more particularly, relates to a dispenser that dispenses individual sheets of a pre-moistened web material, such as a wipe, from the center of a roll and includes a feature that controls the flow of fluid from the pre-moistened web material so as to cause any fluid pulled downward within the roll by gravity to be reabsorbed by the roll.

BACKGROUND

There are a number of different commercially available dispensers for dispensing products, such as paper towel products or wipes, that typically come in sheet form. One method of dispensing involves a "center-pull" mechanism, whereby the sheet material is removed from the center of a coreless roll. The sheet material is pulled through a restricted opening that frictionally resists the pulling motion from the user. This resistance results in the sheet material tearing away into individual sheets at predetermined points marked by partially severed lines.

One of the more common center-pull dispenser designs uses a cone or funnel shaped nozzle to provide the opening for resisting and dispensing the sheet material. This design provides a large initial entrance for the end of the sheet material roll that allows for easy insertion of the end of a new roll, while also having the restricted exit opening necessary to provide sufficient resistance to allow tearing of the perforations.

However, there are several deficiencies associated with existing center-pull dispenser designs. One deficiency of the conventional standard center-pull design is that the platform on which the web sits is typically planar or flat, with a funnel-shaped opening being formed in the platform that cooperates with a lower opening formed in the housing of the dispenser. Typically, the web that is used in the center-pull dispenser is a dry web as opposed to a pre-moistened web. One of the problems of using a pre-moistened web in this type of center-pull dispenser construction is that gravity pulls the moisture in the web roll itself down toward the bottom portion of the roll that sits on the platform or the like. This is understandable since gravitational forces will act on the liquid that wets the web since the liquid has a greater density than the fibrous web. The problems that result from this gravitational flow are two-fold, namely, first that the liquid that pools at the bottom of the web tends to drip from the bottom feed center-pull opening onto the ground and secondly, the upper portion of the web does not contain the same moisture level as the increasingly saturate bottom portion. This leads to the upper portion potentially drying out, while the bottom portion drips onto the ground which is undesirable since it may soil the ground or in any event leaves an unpleasant drip on the ground.

It is therefore desirable to provide a sheet material dispenser of a center-pull bottom feed design that is constructed so that pre-moistened webs can be used therein without experiencing the above drip phenomena.

SUMMARY

According to one exemplary embodiment of the present invention, a bottom feed center-pull dispenser includes a housing defining a compartment and including a center-pull bottom feed arrangement for dispensing a sheet material that is in the form of a roll of the sheet material. The sheet material can be a pre-moistened airlaid web that is provided as a coreless roll.

The dispenser also includes a tray that supports the airlaid roll and includes an outlet opening through which the airlaid roll is fed to be accessible to a user. The tray includes a moisture retaining feature that directs fluid from the pre-moistened air-laid web away from the outlet opening and toward an outer peripheral edge of the roll.

In one embodiment, the tray includes a bottom support surface on which the roll rests and the moisture retaining feature is provided by incorporating a negative slope in the bottom support surface as measured radially outward from a center portion to an outer peripheral edge thereof. The roll is orientated on the bottom support surface so as to cause any fluid within the airlaid web that is pulled downward toward the bottom support surface due to gravitational forces to flow radially outward from the center portion toward the outer peripheral edge to prevent the fluid from dripping out of the outlet opening and to make the fluid available for reabsorption into the airlaid web material.

In yet another aspect of the present invention, the airlaid web includes either a disinfectant or an antiseptic agent to provide cleaning properties to the web product. A disinfectant is used to clean surfaces, such as counter tops and exercise equipment, while an antiseptic agent is provided for cleaning a surface of the body, such as the hands. The composition of the airlaid web is tailored depending upon whether a disinfectant or an antiseptic agent is used in the airlaid web and in particular, the specific type of binder is selected in view of the type of disinfectant or antiseptic agent that is incorporated into the airlaid web.

Other features and advantages of the present invention will be apparent from the following detailed description when read in conjunction with the accompanying drawings.

BRIEF DESCRIPTION OF THE DRAWING FIGURES

The foregoing and other features of the present invention will be more readily apparent from the following detailed description and drawings figures of illustrative embodiments of the invention in which.

DETAILED DESCRIPTION OF PREFERRED EMBODIMENTS

Figure 1:
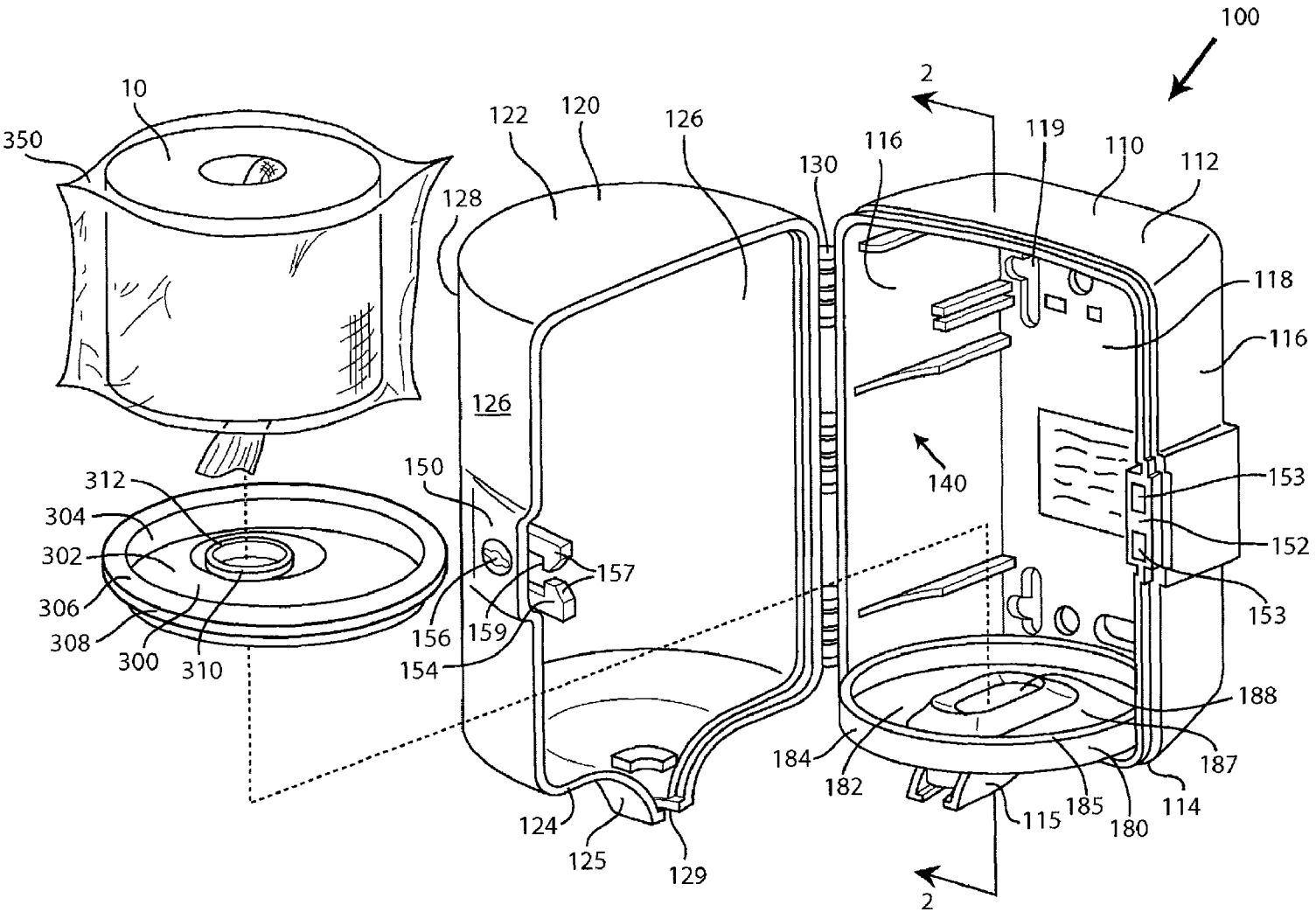
FIG. 1 is a partially exploded front perspective view of a dispenser in an open position and with a secondary tray removed therefrom.
Figure 2:
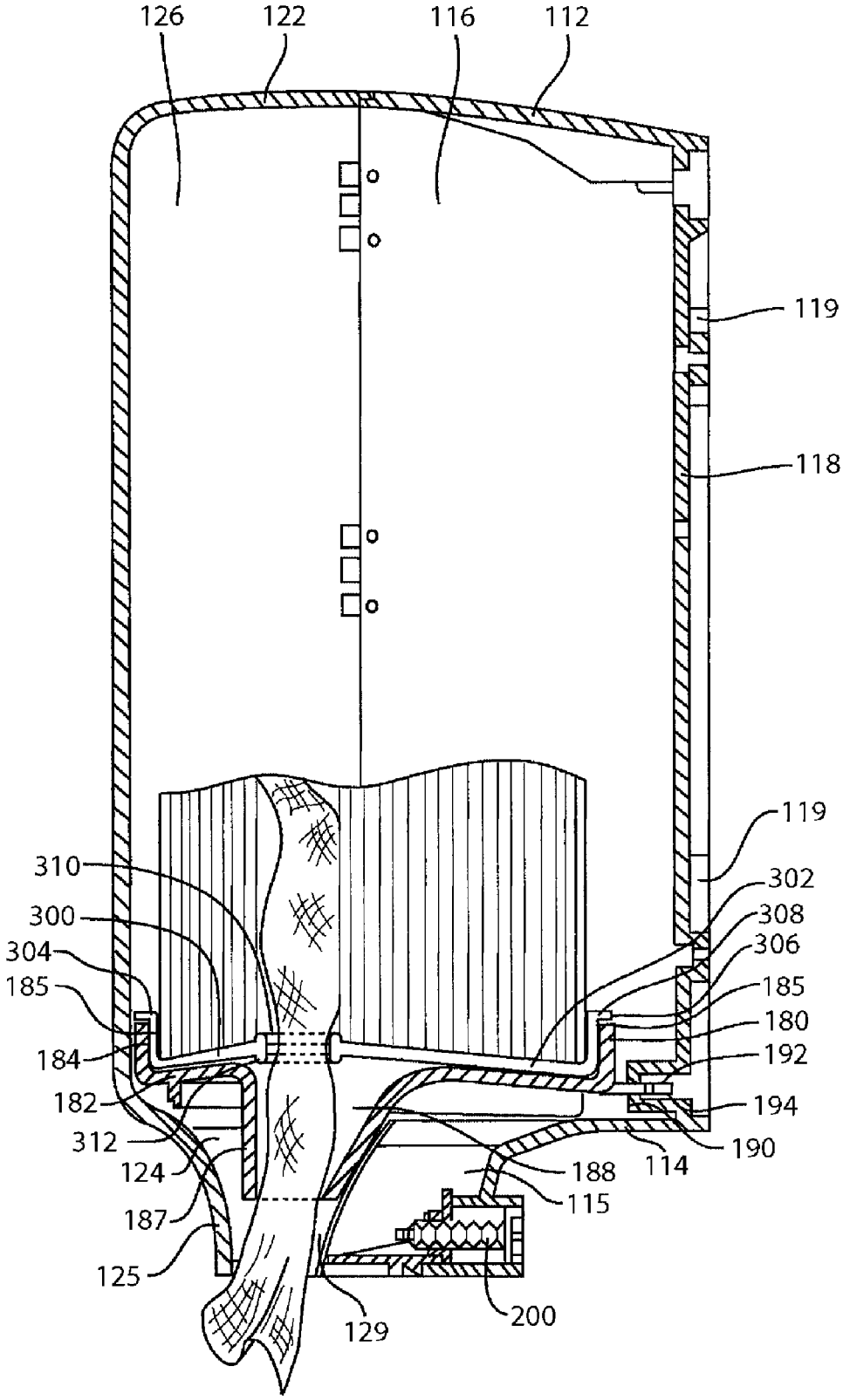
FIG. 2 is a cross-sectional view of the dispenser of FIG. 1.
Figure 3:
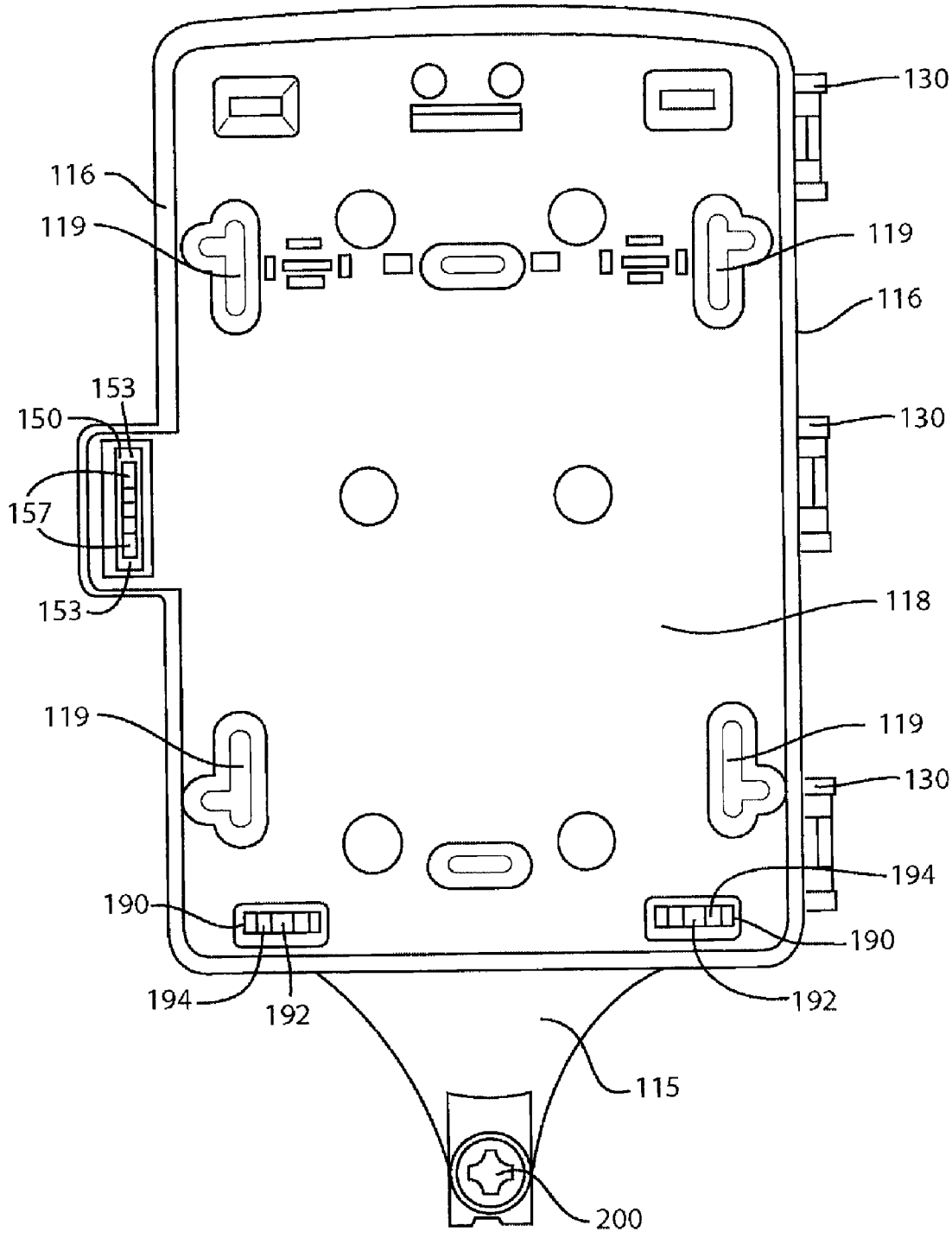
FIG. 3 is a rear elevation view of the dispenser of FIG. 1.

FIGS. 1-3 show a dispenser 100 that is formed of a housing 110 and a door 120 that is opened and closed relative to the housing 110. The door 120 can be pivotably coupled to the housing 110 using any number of techniques, including using hinges or the like 130 or other type of hardware. The housing 110 and the door 120 define the overall outer structure of the dispenser 100 as well as define an inner compartment 140 that houses and contains a roll of web material 10 that is dispensed by means of the dispenser 100. Preferably and as illustrated, the housing 110 has a generally square or rectangular shape, while the door 120 has a generally hemispherical shape such that once the door 120 is closed, the compartment 140 is of sufficient size to accommodate the roll of web material 10 without placing any constraint or undue force against the roll 10 to ensure smooth operation of the dispenser 100.

The dispenser 100 has an upper wall that is defined by an upper wall 112 of the housing 110 and an upper wall 122 of the door 120. The dispenser 100 has a bottom wall that is defined by a bottom wall 114 of the housing 110 and a bottom wall 124 of the door 120. Each of the housing 110 and the door 120 also includes a pair of side walls as well as a rear wall and a front wall, respectively. More specifically, the housing 110 includes a pair of side walls 116 and a rear wall 118 that are formed between the upper wall 112 and the bottom wall 114. The door 120 includes a pair of side walls 126 and a front wall 128 that are formed between the upper wall 122 and the bottom wall 124. When the door 120 closes relative to the housing 110, the exposed edges of the side walls 116, 126 abut or are in close proximity to one another, while the exposed edges of the upper walls 112, 122 and the exposed edges of the bottom walls 114, 124 abut or are in close proximity to one another.

The bottom walls 114, 124 of the housing 110 and door 120 are not planar in nature but instead contain complementary funnel outlet portions 115, 125 that defines the funnel outlet through which the web is received. When the door 120 is closed and the two funnel outlet portions 115, 125 come together, an exit opening 129 is formed and represents the opening that a leading web sheet 10 passes through and is visible for grasping by the user.

As will be described below, the funnel outlet portions 115, 125 can contain an adjustment mechanism 200 that serves to either reduce or enlarge the size of the exit opening 129. Each of the funnel outlet portions 115, 125 is generally hemispherical in shape and concave in nature to permit the web to be directed and fed down through the outlet or exit opening 129 which is formed when the perimeter edges of the door 120 interface with the perimeter edges of the housing 110.

Any conventional method can be used to secure the housing 110 to a wall for mounting the dispenser 100. For example and as shown, holes 119 can be included in the rear wall 118 of the housing 110 to allow for screws to secure the housing 110 to the wall.

The dispenser 100 also preferably has a lock mechanism 150 that is configured to retain the door 120 in the closed position by means of locking the door 120 relative to the housing 110. Any number of different types of lock mechanisms 150 can be used, including latch and key type mechanisms. In the illustrated embodiment, the locking mechanism 150 includes a first part 152 that is associated with the housing 110 and a second part 154 that is associated with the door 120. For example, the first part 152 can be in the form of a latch housing that includes a pair of openings or slots 153 that receive complementary locking features of the locking mechanism 150. More specifically, the second part 154 includes a lock assembly that has a keyed section 156 that receives a key and includes a pair of adjustable biased tangs 157 such that to lock the dispenser 100, the tangs 157 are inserted into the openings 153 and a beveled hook or latch or catch 159 of each tang 157 engages an edge defining one of the openings 153 causing the tang 157 to spread apart from one another. Once the beveled hook or catch 159 clears the edge, the biasing force of the tang 157 causes the tangs 157 to move back toward another to the initial biased position. The key is not needed to lock the door 120 since this occurs due to the natural biasing action of the tangs 157. To open the door 120, the key is simply inserted into the keyed section 156 and rotated causing the tangs 157 to separate from one another. This results in the catches/hooks 159 of the tangs 157 clearing the edges of the openings 153, thereby permitting the door 120 to be opened. Once the door 120 is opened and the key is removed, the tangs 157 return to their natural inwardly biased condition.

It will be understood that other lock mechanisms can be used and the above described one is merely exemplary in nature.

The dispenser also has a platform or support member 180 that is operatively coupled to the housing 110 for supporting the web 200. In the illustrated embodiment, the support member 180 is a separate part from the housing 110 and the door 120. The support member 180 can be of the type that is detachably coupled to the housing 110 by means of a coupling mechanism 190 as described below. The support member 180 can also be thought of as a main tray of the dispenser 100 for supporting the roll of web material 10 as described in greater detail below.

The support member 180 is a generally funnel-shaped member and includes a bottom platform or support surface 182 that is surrounded about its outer edge or perimeter by a lip or vertical wall 184. Since the bottom support surface 182 is preferably circular in shape, the vertical wall 184 is annular shaped. The vertical wall 184 is preferably formed at a right angle to the outer perimeter edge of the bottom support surface 182. The support surface 182 also includes a funnel-shaped portion 187 that extends downwardly from the support surface 182 and defines a bottom funnel-shaped outlet 188 that interfaces with the exit opening 129 defined in the bottom of the housing 110 and door 120. The bottom support surface 182 is not planar in nature but instead the bottom surface 182 has a smooth sloped appearance in that the bottom support surface 182 has a maximum height at its center portion where the outlet 188 is located and has a negative slope as measured radially from the center portion toward the outer perimeter edge of the bottom support surface 182. In other words, the outer perimeter edge of the bottom support surface 182 has a height less than the center portion and therefore, a smooth downwardly (negative) sloped surface is provided.

The raised central portion of the bottom support surface 182 has a height that is preferably less than the height of an upper edge 185 of the vertical wall 184 as shown. The funnel shaped portion 187 has a smooth inner surface since the web sheet 10 travels down through the funnel shaped portion 187 to the outlet where it then is fed to and through the adjustment mechanism 200 and ultimately through the exit opening 129 so as to be accessible to be grasped by the user.

An underside of the bottom support surface 182 can contain one more guide and positioning features, such as rigid ribs or rails, for positioning and retaining the support member 180 in relation to the housing 110 and the door 120. For example, a pair of ribs can be formed on the underside and can be contoured so that they sit against a top surface of the bottom wall 118 of the housing 110. These underside ribs serve to position and properly elevate the support member 180 so that the support member 180 is not substantially inclined or declined relative to the housing 110 and the door 120. This ensures that the web roll is held in a stable position, preferably perpendicular to the ground surface along a vertical axis of the web, when the dispenser 100 is mounted on the wall. When the door 120 is closed relative to the housing 110, a front or forward portion of the support member 180 is received within the cavity defined by the walls of the door 120.

The coupling mechanism 190 can be any number of different mechanisms that can be used to releasably couple the support member 180 to the housing 110. In the illustrated embodiment, a flange 192 is provided at the rear of the support member 180 and extends outwardly therefrom. The flange 192 includes at least one and preferably, two pairs of locking tabs, tangs or arms 194 that extend outwardly therefrom and are received within openings or slots formed in the rear wall 118 of the housing 110. As with the door lock mechanism 150, the tangs 194 have a catch or latch or hook that engages an edge that defines the opening formed in the rear wall of the housing 110. The tangs 194 are biased outwardly so that initially when the tangs 194 are inserted into the opening, the wall edge of the opening forces the tangs 194 inwardly toward one another until the catches/hooks clear the wall edges at which time the biasing force of the tangs 194 causes the tangs 194 to spread apart from one another, thereby locking the support member 180 to the housing 110.

To release the support member 180 from its locked position, the user simply needs to manipulate the ends of the tangs 194 with his/her fingers so that the tangs 194 are compressed toward one another until each catch clears the wall edge of the opening. This results in the tangs 194 disengaging from the housing 110 and the support member 180 can be removed therefrom.

When the support member 180 is in the locked position relative to the housing 110, the funnel shaped portion 187 is axially aligned with the funnel outlet portions 115, 125 so that as the leading sheet of the roll 10 is fed through the funnel shaped portion 187, it is fed directly into the funnel outlet portions 115, 125 and then through the exit opening 129.

The dispenser 100 can be formed from any number of different materials; however, it is typically formed of a plastic material that this rigid and strong yet light at the same time. The door 120 can be formed of a different material from the housing 110 and/or it can be formed so that it is transparent in nature to thereby permit a user to look into the dispenser compartment 140 and view the roll of web material 10.

As best shown in FIGS. 1-4, the dispenser 100 includes a secondary tray 300 that is supported by support member (main tray) 180. The bottom support member 180 can also be thought of as a main tray. The secondary tray 300 is complementary to the main tray 180 and is configured so that the roll of web material 10 is supported on the secondary tray 300 which in turns rests on and is supported by the support member 180.

The secondary tray 300 has a bottom support surface 302 and a lip or vertical wall 304 that is formed around an outer perimeter edge of the bottom support surface 302. In the illustrated embodiment, the vertical wall 304 is preferably formed at a right angle with respect to the bottom support surface 302. The illustrated bottom support surface 302 has a circular shape and therefore, the vertical wall 304 has an annular shape. At an upper edge 306 of the vertical wall 304, a lip or flange 308 is formed and extends outwardly therefrom. As illustrated, the lip 308 can be formed at a right angle relative to the vertical wall 304. When the secondary tray 300 is placed within the main tray 180 above the bottom support surface 182, the secondary tray 300 can be held in place by resting the lip 308 on the upper edge 185 of the vertical wall 184 of the support member 180.

Figure 4:
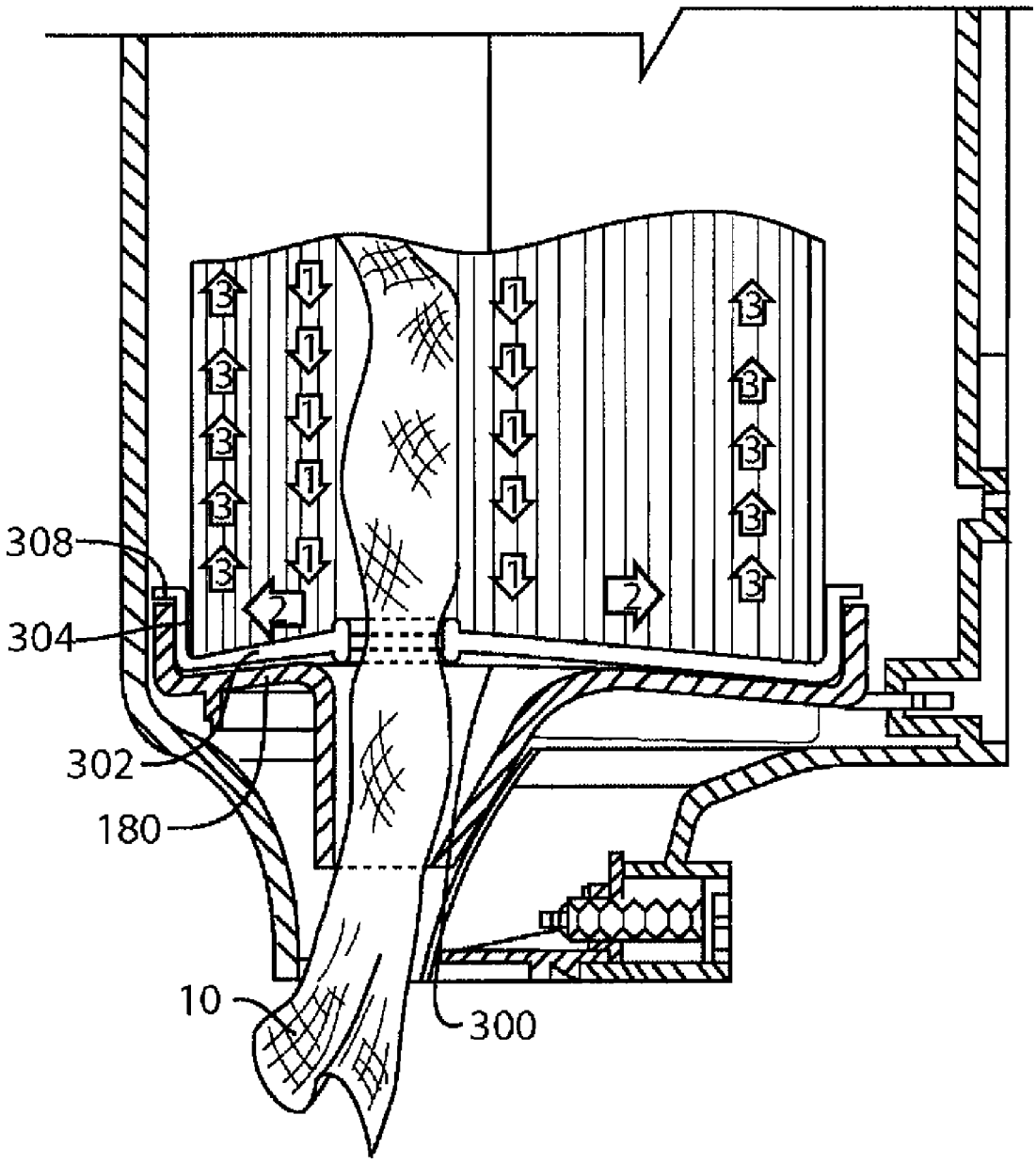
FIG. 4 is a cross-sectional view of the dispenser of FIG. 1.

Similar to the construction of the bottom support member 180, the secondary tray 300 has a sloped construction and in particular, the bottom support surface 302 is not planar but rather is a sloped surface with respect to the vertical wall 304. The secondary tray 300 has a center portion with a web outlet opening 310 being formed therein. The slope of the secondary tray 300 is similar to the slope of the main tray 180 in that the bottom support surface 302 has a negative slope as measured from the center portion toward the outer peripheral edge where the vertical wall 304 is formed. The negatively sloped nature of the secondary tray 300 is illustrated in FIGS. 2 and 4.

The web outlet opening 310 is generally axially aligned with the funnel shaped portion 187 so that the web sheet from roll 10 can be fed through the outlet opening 310 directly into the funnel shaped portion 187 and then is fed in the manner described above. The secondary tray 300 can have an increased thickness around the center web outlet opening 310 so as to form a rim or the like 312. The rim 312 can have smooth beveled edges or rounded edges 314 so as to create a smooth surface over which the web sheet 10 can travel and slide along as the user pulls the exposed web sheet material 10 and a next web sheet is loaded into the funnel shaped portion 187.

When the lip 308 sits on the upper edge 185 of the vertical wall 404, the secondary tray 300 can be constructed so that the bottom support surface 302 can either rest on the bottom support surface 182 of the bottom support 180 which lies below the secondary tray 300 or the bottom support surface 302 can lie slightly above the bottom support surface 182 of the bottom support 180. In either embodiment, the web outlet opening 310 is generally axially aligned with the funnel shaped portion 187 and in particular, lies directly thereabove.

Since the secondary tray 300 and the main tray 180 have complementary negatively sloped bottom surfaces, the sloped portions generally mirror one another with the secondary tray 300 merely lying above the main tray. The secondary tray 300 is freely removable since it merely rests on the main tray 300, while the main tray 180 is fixed to the housing 110 as by the snap-fit coupling described above.

As best shown in FIG. 4, both the main tray 180 and the secondary tray 300 are configured to overcome the above described deficiencies that are associated with the conventional center-pull dispensers. More specifically, the dispenser 100 according to the present invention has a moisture control feature incorporated therein which either eliminates or substantially reduces the drip phenomena that is associated with conventional dispenser design when pre-moistened wipes are used in such dispensers. In particular, the sloped nature of both the secondary tray 300 and the main tray 180 acts as the moisture control feature since the secondary tray 300 is constructed so that any fluid (liquid) within the pre-moistened web that flows to the bottom of the dispenser 100 by gravity, as shown by arrow 1 in FIG. 4, does not merely flow or drip out of the exit opening but instead, the fluid is directed to the outer periphery of the roll 10 where it is then reabsorbed by the roll 10 (e.g., as by a wicking action). Thus, there is no dripping of liquid out of the exit opening 129 and the roll 10 maintains its moisture.

It will be appreciated that any moisture within the roll 10 that flows by gravity toward the bottom support surface 302 of the secondary tray 300 (arrow 1) will naturally flow away from the outlet opening 310 formed therein and in communication with the underlying main tray (support member) 180 since the outlet opening 310 is formed in the center at a high point of the bottom surface 302 and therefore, fluid will naturally flow toward the outer peripheral edge of the secondary tray 300, as indicated by arrow 2, since this represents a low point of the secondary tray 300. In other words, the fluid will flow toward the vertical wall 304 of the secondary tray 300 that is located at its outer peripheral edge.

As the fluid travels along the sloped bottom support surface 302, the fluid is able to be wicked up by the roll 10, as indicated by arrow 3, in regions that are not completely saturated and even in regions of complete saturation, the fluid will simply continue to flow down the bottom support surface 302 toward the vertical wall 304 where it can collect to be reabsorbed (e.g., wicking action) back into the roll of web material 10 or merely be reabsorbed by non-saturated outer layers of the roll 10 before reaching the vertical wall 304.

The secondary tray 300 is also constructed for easy loading of the roll of web material 10 since the roll of web material 10 is merely placed on the bottom support surface 302. For example, the web material initially can be distributed in roll form with a center core member for support during transportation of the roll of web material 10. The roll of web material 10 is also typically disposed within some type of sealed protective member 350 to both protect the web roll and also to ensure that the pre-moistened web roll remains saturated with the liquid and does not dry out prior to use in the dispenser. In the illustrated embodiment, the sealed protective member 350 is in the form of a plastic bag that contains and seals the roll 10. The plastic bag 350 has an opening (not shown) formed therein at one end to permit passage of the web sheet material therethrough and preferably, the bag opening and the center of the web roll (and the core member initially) are generally axially aligned since the core member is removed from the plastic bag 350 through the opening.

The opening is initially covered with a removable seal member, such as an adhesive label or the like. Once the seal member is removed, access to the roll of web material 10 is permitted and the core member is removed from the web roll 10 to transform it into a coreless roll 10 for use in the dispenser 100. The center web sheet material is pulled from the center through the opening and then the plastic bag 350 containing the roll of web material 300 is placed on the bottom support surface 302 of the secondary tray 300 so that the opening faces the bottom support surface 302 with the pulled center web sheet material being fed through the web outlet opening 310 directly into the funnel shaped portion 187 of the underlying main tray 180 and then through the exit opening 129, through the adjustment mechanism 200 to the user.

It will be understood that after feeding the leading web sheet through the opening 302 of the secondary tray 300, the second tray 300 can be further lowered onto the bottom support surface 182 of the support member 180. At the same time, the leading web sheet is fed into the funnel shaped portion 187 as described above. It will further be appreciated that the dispenser 100 can operate with only the main tray 180 in use in which case the secondary tray 300 is not used. In this embodiment, the roll of web material 10 is merely placed on top of and supported by the bottom support surface 182 of the main tray 180. Since the main tray 180 includes a sloped bottom surface 182, the moisture retaining feature discussed above with respect to the secondary tray 300 is also present when only the main tray 180 is used.

The secondary tray 300 adds additional support to the roll of web material 10 and also increases the ease at which the roll of web material 10 is prepared for use in the dispenser. In other words, the roll of web material 10 can be prepped for use in the dispenser in a location outside of the compartment 140 of the dispenser 100 since the package 350 can be opened and inverted to place the roll 10 on the bottom support surface 302.

In one preferred embodiment, the roll of web material 10 is in the form of a moisture ladened airlaid web. As is known, airlaid webs offer a number of advantages over other types of web materials including that they can absorb a significant amount of liquid and therefore, are quite suitable for use as a pre-moistened web for use in a center-pull dispenser design. Conventional center-pull dispensers do not use airlaid web structures and furthermore, because of the above-described drip phenomena, the conventional center-pull dispensers are not pre-moistened but are merely dry web materials arranged in roll form. Airlaid webs typically use a binder material during the airlay process to ensure the structural integrity of the web roll. The roll 10 contains a number of perforated web sheets depending upon the particular application and also can contain any number of suitable agents, such as anti-bacterial agents, moisturizing or softening agents, or other skin care agents, etc. In one exemplary embodiment, the roll 10 contains 500 pre-moistened perforated wipes that are intended for personal care/baby wipe applications, while in another embodiment, the roll 10 contains 450 pre-moistened perforated wipes that are intended for use in anti-bacterial hand cleaner applications or anti-bacterial surface cleaner applications.

One exemplary adjustment mechanism 200 is disclosed in U.S. Pat. No. 6,510,964, which is hereby incorporated by reference in its entirety. The adjustment mechanism 200 is merely a mechanism that is manually or even automatically manipulated so that the cross-sectional area of the exit opening 129 can be varied depending upon a number of factors, including the type of web material being used and the condition of the funnel shaped opening parts 115, 125.

The dispenser 100 according to the present invention offers a number of advantages over conventional center-pull dispensers and is particularly suited for use with center-pull airlaid webs, and more particularly, with pre-moistened airlaid webs that previously could not be used due to the drip phenomena discussed above. The fluid control system of the present invention ensures that all types of pre-moistened webs can be used in the present invention in a center-pull design. The use of airlaid webs permits a complete line of pre-moistened wipes to be marketed and used with the dispenser 100. In addition, the reliability of center-pull airlaid webs is realized in the present invention and the pre-moistened airlaid web can easily be pre-packaged in a sealed environment, such as a plastic bag. Another advantage is that the present dispenser 100 and use of airlaid roll 10 provides a level of convenience and also eliminates cross-contamination for pre-moistened towels in the Away-From-Home (AFH) market.

As previously mentioned, the airlaid web (roll of wipes) for use in the dispensers according to the present invention is preferably an airlaid nonwoven material which generally contains matrix fibers and binder. The purpose of the binder when present is to consolidate and hold the material together. The term "matrix fiber" as used herein refers to a synthetic or cellulosic fiber that does not melt or dissolve to any degree during the forming or bonding of the nonwoven. A wide variety of natural and synthetic fibers are suitable for use as matrix fibers. Preferred matrix fibers are cellulosic fibers.

Cellulosic fibrous materials suitable for use in the present invention include softwood fibers and hardwood fibers. See M. J. Kocurek & C. F. B. Stevens, *Pulp and Paper Manufacture—Vol.* 1: *Properties of Fibrous Raw Materials and Their Preparation for Pulping*, which is hereby incorporated by reference in its entirety, The Joint Textbook Committee of the Paper Industry, 1983, 182 pp. Exemplary, though not exclusive, types of softwood pulps are derived from slash pine, jack pine, radiata pine, loblolly pine, white spruce, lodgepole pine, redwood, and douglas fir. North American southern softwoods and northern softwoods may be used, as well as softwoods from other regions of the world. Hardwood fibers may be obtained from oaks, genus *Quercus*, maples, genus *Acer*, poplars, genus *Populus*, or other commonly pulped species. In general, softwood fibers are preferred due to their longer fiber length as measured by T 233 cm-95, and southern softwood fibers are most preferred due to a higher coarseness as measured by T 234 cm-84, which leads to greater intrinsic fiber strength as measured by breaking load relative to either northern softwood or hardwood fibers. Other suitable cellulose fibers include those derived from Esparto grass, bagasse, jute, ramie, kenaff, sisal, abaca, hemp, flax and other lignaceous and cellulosic fiber sources. Also preferred is cotton linter pulp, chemically modified cellulose such as crosslinked cellulose fibers and highly purified cellulose fibers, such as Buckeye HPF, each available from Buckeye Technologies Inc., Memphis, Tenn.

The fibrous material may be prepared from its natural state by any pulping process including chemical, mechanical, thermomechanical (TMP) and chemithermomechanical pulping (CTMP). These industrial processes are described in detail in R. G. Macdonald & J. N. Franklin, *Pulp and Paper Manufacture in* 3 *volumes; 2nd Edition, Volume* 1: *The pulping of wood,* 1969, *Volume* 2: *Control, secondary fiber, structural board, coating,* 1969, *Volume* 3: *Papermaking and paperboard making,* 1970, The joint Textbook Committee of the Paper Industry, and in M. J. Kocurek & C. F. B. Stevens, *Pulp and Paper Manufacture, Vol.* 1: *Properties of Fibrous Raw Materials and Their Preparation for Pulping*, The Joint Textbook Committee of the Paper Industry, 1983, 182 pp., both of which are hereby incorporated by reference in their entirety. Preferably, the fibrous material is prepared by a chemical pulping process, such as a Kraft or sulfite process. In particular the Kraft process is especially preferred. Pulp prepared from a southern softwood by a kraft process is often called SSK. In a similar manner, southern hardwood, northern softwood and northern hardwood pulps are designated SHK, NSK & NHK, respectively. Bleached pulp, which is fibers that have been delignified to very low levels of lignin, are preferred, although unbleached kraft fibers may be preferred for some applications due to lower cost, especially if alkaline stability is not an issue. Thermomechanical cellulose fiber may be used. Desirably, the cellulose fiber for use as a matrix fiber has been derived from a source which is one or more of Southern Softwood Kraft, Northern Softwood Kraft, hardwood, eucalyptus, mechanical, recycle and rayon, preferably Southern Softwood Kraft, Northern Softwood Kraft, or a mixture thereof, more preferably, Southern Softwood Kraft.

Crosslinked cellulose fibers, also known in the industry as curly fibers, can be used in this invention, particularly when it is desired to achieve extremely high caliper (thickness) of the nonwoven material and retain resiliency of the structure. Crosslinked fibers are described in U.S. Pat. Nos. 4,898,462; 4,889,595; 4,888,093; 4,822,453, all of which are hereby incorporated by reference in their entirety. Recycled cellulose fibers from cardboard and newsprint are further embodiments, as long as the recycled fibers can be individualized sufficiently to enter the air-stream of the airlaid machine.

The cellulose fibers may be blended with synthetic fibers such as polyester, nylon, polyethylene or polypropylene. Synthetic fibers suitable for use as a matrix fiber include cellulose acetate, polyolefin including polyethylene and polypropylene, nylon, polyester including polyethylene terephthalate (PET), vinyl chloride, and regenerated cellulose such as viscose rayon, glass fibers, ceramic fibers, and the various bicomponent fibers known in the art. While bicomponent fibers may serve as matrix fibers in the nonwoven material of this invention, they will be more fully described and discussed below in the context of their role as a binder fiber.

Other synthetic fibers suitable for use in various embodiments as matrix fibers or as bicomponent binder fibers include fibers made from various polymers including, by way of example and not by limitation, acrylic, polyamides (such as, for example, Nylon 6, Nylon 6/6, Nylon 12, polyaspartic acid, polyglutamic acid, and so forth), polyamines, polyimides, polyacrylics (such as, for example, polyacrylamide, polyacrylonitrile, esters of methacrylic acid and acrylic acid, and so forth), polycarbonates (such as, for example, polybisphenol A carbonate, polypropylene carbonate, and so forth), polydienes (such as, for example, polybutadiene, polyisoprene, polynorbomene, and so forth), polyepoxides, polyesters (such as, for example, polyethylene terephthalate, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate, and so forth), polyethers (such as, for example, polyethylene glycol (polyethylene oxide), polybutylene glycol, polypropylene oxide, polyoxymethylene (paraformaldehyde), polytetramethylene ether (polytetrahydrofuran), polyepichlorohydrin, and so forth), polyfluorocarbons, formaldehyde polymers (such as, for example, urea-formaldehyde, melamine-formaldehyde, phenol formaldehyde, and so forth), natural polymers (such as, for example, cellulosics, chitosans, lignins, waxes, and so forth), polyolefins (such as, for example, polyethylene, polypropylene, polybutylene, polybutene, polyoctene, and so forth), polyphenylenes (such as, for example, polyphenylene oxide, polyphenylene sulfide, polyphenylene ether sulfone, and so forth), silicon containing polymers (such as, for example, polydimethyl siloxane, polycarbomethyl silane, and so forth), polyurethanes, polyvinyls (such as, for example, polyvinyl butyral, polyvinyl alcohol, esters and ethers of polyvinyl alcohol, polyvinyl acetate, polystyrene, polymethylstyrene, polyvinyl chloride, polyvinyl pryrrolidone, polymethyl vinyl ether, polyethyl vinyl ether, polyvinyl methyl ketone, and so forth), polyacetals, polyarylates, and copolymers (such as, for example, polyethylene-co-vinyl acetate, polyethylene-co-acrylic acid, polybutylene terephthalate-co-polyethylene terephthalate, polylauryllactam-block-polytetrahydrofuran, and so forth).

Binders suitable for use in the nonwoven material of the present invention may be various bicomponent binder fibers or mixtures thereof, various latices or mixtures thereof, or bicomponent fibers or mixtures thereof in combination with various latices or mixtures thereof, which may be thermoplastic, thermosetting or a mixture thereof. Thermoplastic powders may be used in various embodiments, and may be included in the nonwoven as a fine powder, chip or in granular form.

Bicomponent fibers having a core and sheath are known in the art. Many varieties are used in the manufacture of nonwoven materials, particularly those produced by airlaid techniques. Various bicomponent fibers suitable for use in the present invention are disclosed in U.S. Pat. Nos. 5,372,885 and 5,456,982, both of which are hereby incorporated by reference in their entirety. Examples of bicomponent fiber manufacturers include KoSa (Salisbury, N.C.), Trevira (Bobingen, Germany) and ES Fiber Visions (Athens, Ga.).

Bicomponent fibers may incorporate a variety of polymers as their core and sheath components. Bicomponent fibers that have a PE (polyethylene) or modified PE sheath typically have a PET (polyethyleneterephthalate) or PP (polypropylene) core. In one embodiment, the bicomponent fiber has a core made of polyester and sheath made of polyethylene.

Various latex binders are suitable for use in the nonwoven material of this invention, such as, for example, ethyl vinyl acetate copolymers such as AirFlex 124 (Air Products, Allentown, Pa.) with 10 percent solids and 0.75 percent by weight Aerosol OT (Cytec Industries, West Paterson, N.J.), which is an anionic surfactant. Other classes of emulsion polymer binders such as styrene-butadiene and acrylic binders may also be used. Binders AirFlex 124 and 192 from Air Products, Allentown, Pa., optionally having an opacifier and whitener, such as, for example, titanium dioxide, dispersed in the emulsion may also be used. Other classes of emulsion polymer binders such as styrene-butadiene, acrylic, and carboxylated styrene butadiene acrylonitrile (SBAN) may also be used. A carboxylated SBAN is available as product 68957-80 from Dow Reichhold Specialty Latex LLC of Research Triangle Park, N.C. The Dow Chemical Company, Midland Mich. is a source of a wide variety of suitable latex binders, such as, for example, Modified Styrene Butadiene (S/B) Latexes CP 615NA and CP 692NA, and Modified Styrene Acrylate (S/A) Latexes, such as, for example, CP6810NA. A wide variety of suitable latices are discussed in Emulsion Polymers, Mohamed S. El-Aasser (Editor), Carrington D. Smith (Editor), I. Meisel (Editor), S. Spiegel (Associate Editor), C. S. Kniep (Assistant Editor), ISBN: 3-527-30134-8, from the 217th American Chemical Society (ACS) Meeting in Anaheim, Calif. in March 1999, and in Emulsion Polymerization and Emulsion Polymers, Peter A. Lovell (Editor), Mohamed S. El-Aasser (Editor), ISBN: 0-471-96746-7, published by Jossey-Bass, Wiley. Also useful are various acrylic, styrene-acrylic and vinyl acrylic latices from Specialty Polymers, Inc., 869 Old Richburg Rd., Chester, S.C. 26706. Also useful are Rhoplex™ and Primal™ acrylate emulsion polymers from Rohm and Haas.

In accordance with one aspect of the present invention, the roll of web material 10 is processed so that it contains one of a disinfecting agent, an antiseptic agent or some other type of sanitizing agent for cleaning either a surface of an object, such as countertop, telephone, fitness equipment, etc., and/or a surface of the body, such as the hands. In general, disinfectant are chemical substances that are used to destroy viruses and microbes (germs), such as bacteria and fungi. An antiseptic is a substance that prevents the growth and reproduction of various microorganisms (such as bacteria, fungi, protozoa, and viruses) on the external surfaces of the body. Some antiseptics are true germicides in that they are capable of destroying bacteria, whilst others merely prevent or inhibit their growth.

Any number of different types or classes of disinfectant agents can be used in the present invention so long as the disinfectants are suitable for use and incorporation into an airlaid web material, such as the roll of wipes 10.

For example, disinfectants that can be incorporated into the roll 10 include tetraalkyl or trialkyl benzyl ammonium salts which are manufactured by Lonza, S. A. They are: Bardac 2180 (or 2170) which is N-decyl-N-isononyl-N,N-dimethyl ammonium chloride; Bardac 22 which is didecyl dimethyl ammonium chloride; Bardac 114 which is N,Ndioctyl-N,N-dimethyl ammonium chloride; Bardac 114 which is a mixture in a ratio of 1:1:1 of N-didecyl-N,N-dimethyl ammonium chloride/N-alkyl-N-ethyl phenylmethyl-N,N-dimethyl-N-ethyl ammonium chloride; and Barquat MB-50 which is N-alkyl-N,N-dimethyl-N-benzyl ammonium chloride.

Accordingly, a wide range of quaternary compounds can be used as the disinfectant (antimicrobial active) for incorporation into the web of roll material 10. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco/Sherex), and Hyamine® (available from Lonza); (2) di($C_6$-$C_{14}$)alkyl di short chain ($C_{1-4}$ alkyl and/or hydroxyalkl) quaternary such as Bardac® products of Lonza, (3) N-(3-chloroallyl) hexaminium chlorides such as Dowicil® and Dowicil® available from Dow; (4) benzethonium chloride such as Hyamine® from Rohm & Haas; (5) methylbenzethonium chloride represented by Hyamine® 10X supplied by Rohm & Haas, (6) cetylpyridinium chloride such as Cepacol chloride available from of Merrell Labs. Examples of the preferred dialkyl quaternary compounds are di($C_8$-$C_{12}$)dialkyl dimethyl ammonium chloride, such as didecyldimethylammonium chloride (Bardac 22), and dioctyldimethylammonium chloride (Bardac 2050). The quaternary compounds useful as cationic antimicrobial actives herein are preferably selected from the group consisting of dialkyldimethylammonium chlorides, alkyldimethylbenzylammonium chlorides, dialkylmethylbenzylammonium chlorides, and mixtures thereof. Other preferred cationic antimicrobial actives useful herein include diisobutylphenoxyethoxyethyl dimethylbenzylammonium chloride (commercially available under the trade name Hyamine® 1622 from Rohm & Haas) and (methyl)diisobutylphenoxyethoxyethyl dimethylbenzylammonium chloride (i.e. methylbenzethonium chloride).

According to one embodiment, a disinfectant for use in the present invention can be selected from the group consisting of $C_8$-$C_{16}$ alkyl amines, $C_8$-$C_{16}$ alkyl benzyl dimethyl ammonium chlorides, $C_8$-$C_{16}$ dialkyl dimethyl ammonium chlorides, $C_8$-$C_{16}$ alkyl, $C_8$-$C_{14}$ alkyl dimethyl ammonium chloride and chlorhexidine and mixtures thereof.

In one exemplary embodiment, the wipes contain a mixture of alcohol (e.g., isopropyl alcohol) and dual chain quaternary compound, such as n-Alkyl (68% $C_{12}$, 32% $C_{14}$) dimethyl ethylbenzyl ammonium chlorides and n-Alkyl (60% $C_{14}$, 30% $C_{16}$, 5% $C_{12}$, 5% $C_{18}$) dimethyl benzyl ammonium chlorides.

According to another embodiment and as previously mentioned, the wet wipes contain an antiseptic agent that can function as a hand sanitizing agent. Typically, these compounds are alcohol based solutions that are effective at killing substantially all, e.g., 99.9%, of common germs. Accordingly, any number of antiseptic (sanitizing) agents, such as alcohols, can be used according to the present invention to provide a sanitizer wipe. It will be appreciated that other agents, including antiseptic agents, which are agents that kill or inhibit the growth of microorganisms on the external surfaces of the body. An antiseptic is technically different from a disinfectant since a disinfectant destroys microorganisms that are found on nonliving objects. Germicides include only those antiseptics that kill microorganisms. Some common antiseptics are alcohol, iodine, hydrogen peroxide and boric acid. There is a great variation in the ability of antiseptics to destroy microorganisms and in their effect on living tissue.

The present inventors have discovered that a proper pairing between the type of disinfectant or antiseptic agent and the binder of the airlaid material is preferred and results in a more stable, commercially viable and successful wipe product. More specifically and as set forth above, there are a number of agents that can be added to the airlaid wipe product to offer disinfecting or antiseptic properties.

Preferably, when the pre-moistened wipes contain a disinfectant agent, such as a quaternary compound, the binder that is used in the airlaid web is in the form of various bicomponent binder fibers or mixtures thereof as opposed to being a latex based binder since it was found that a combination of bicomponent binder fibers and a disinfectant agent yielded more favorable results compared to when a latex based binder is used. In particular, the chemical interaction between the quaternary compound and latex does not provide optimal integrity to the web material and thus, results in an inferior pre-moistened wipe product.

Conversely, when the pre-moistened wipes contain an antiseptic, such as an alcohol, the binder that is used in the airlaid web is preferably a latex based binder. In general, the use of a latex binder results in a more uniform moisture profile in the roll of web material 10.

However, the antiseptic agent can be incorporated into a airlaid web that has bicomponent fibers as the binder, with the percentage of the bicomponent fibers present in the antiseptic application being less than the application where a disinfectant agent is incorporated into the roll of web material 10. As is know, the bicomponent fibers provides sheet integrity when latex can not be or is not used as the binder material.

Figure 5:
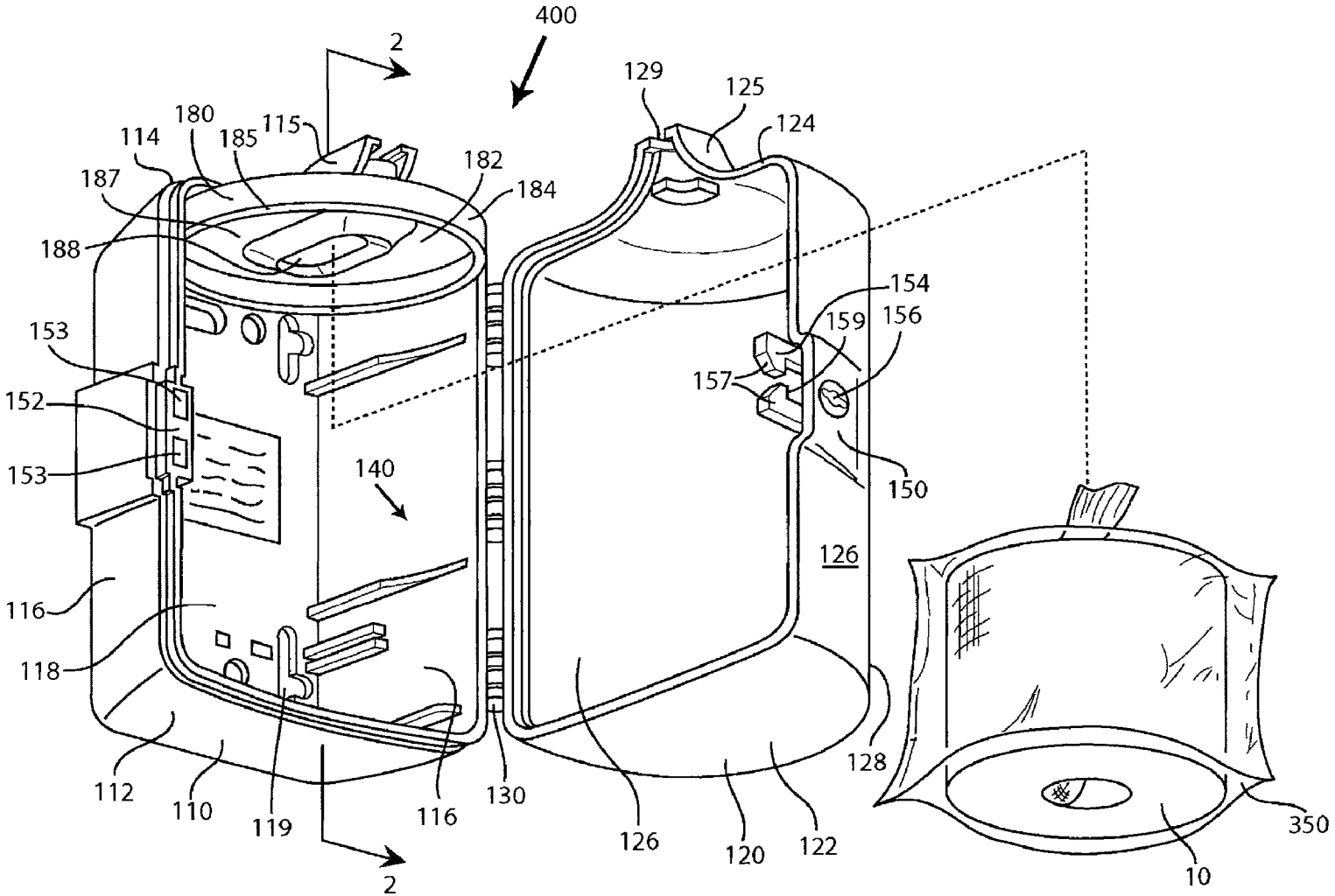
FIG. 5 is a partially exploded front perspective view of a top feed dispenser in an open position with a roll of web material including either an antiseptic agent or a disinfectant.

Now turning to FIG. 5 which illustrates a top feed dispenser 400 that is configured to house and store a roll of pre-moistened airlaid web material (roll 10) that includes a disinfectant agent incorporated therein. The dispenser 400 can have a structure that is similar to the dispenser 100, and therefore like elements are numbered alike, with the exception that the secondary tray 300 is eliminated from the dispenser 400. Instead, the roll of web material 10 seats against the support member 180. In addition, the support member 180 can have more of a planar, flat structure compared to the support member 180 that is shown in FIGS. 1-4. Otherwise, the only significant difference between the dispenser 400 and the dispenser 100 is that the dispenser 400 is a top dispenser in that it is orientated 180 degrees opposite the orientation of the dispenser 100 to permit the user to simply pull one wipe upwardly from the housing 110. The roll 10 is placed into and is removed from the dispenser 400 in the same manner described above in that the housing 110 has a door 120 that can be opened to permit access to the compartment 140.

It will be appreciated that a top feed arrangement is desired when the pre-moistened wipes contain a disinfectant agent since the disinfectant agent results in greater saturation of the wipe product 10 and when it is placed into a bottom feed arrangement, such as dispenser 10, it has a tendency to exhibit dripping of the disinfectant agent as a result of gravitational forces and the location of the spout opening of the dispenser.

However, when the roll of wipes 10 includes an antiseptic agent that is incorporated therein, the roll 10 may be placed in a bottom feed dispenser, such as dispenser 100, since the above dripping effect is not observed when an antiseptic agent is used instead of a disinfectant agent. Thus, when the agent is an alcohol based antiseptic, the roll of wipes 10 can be placed into a bottom feed dispenser, such as dispenser 100.

It will also be appreciated that the sealed protective member (container) 350 for each of the dispenser 100 and 400 can be in a form other than the illustrated plastic bag. More particularly, the sealed protective member 350 can be in the form of a rigid member, such as a plastic cartridge, that holds the web material. The sealed protective member 350 is thus a sealable member that is used to hold the pre-moistened web material and in particular, the sealed protective member 350 serves to contain the fluid that is dispersed throughout the airlaid web material. In either the bottom feed dispenser 100 and the dispenser 400, it is desireable to contain the fluid of the pre-moistened web material (airlaid wipes) so as to limit or prevent any leakage of the fluid.

When the member 350 is formed of a substantially flexible material, such as the illustrated plastic bag, the shape of the member 350 can be conformed to a shape of the compartment so as to cause the member 350 and roll 10 to be held within the compartment. Alternatively, when the member 350 is in the form of a more rigid member, such as a plastic cartridge, the rigid member is constructed so as to be insertable into the compartment of the housing. In addition, the plastic cartridge can engage guide or locating members formed as part of the housing so as to properly locate and hold the cartridge in place in the compartment. For example, a releasable snap-fit arrangement can be provided between the plastic cartridge and the housing or some other type of mechanical fit can be provided.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. A center-pull bottom feed dispenser comprising:

a housing defining a compartment and including a center-pull bottom feed arrangement for dispensing a sheet material, the compartment capable of enclosing a roll of the sheet material which comprises a pre-moistened air-laid web; and a tray disposed in a lower portion of the compartment, the tray capable of supporting the roll, the tray including an outlet opening through which the airlaid web is fed to be accessible to a user, the tray further including a moisture retaining feature that directs fluid from the pre-moistened air-laid web away from the outlet opening and toward an outer peripheral edge of the roll to promote reabsorption thereby, wherein the tray includes a bottom support surface on which the roll rests, the bottom support surface having a negative slope as measured radially outward from a center portion to an outer peripheral edge of the tray, the center portion containing a funnel-shaped outlet portion that terminates in the outlet opening and is formed as part of the bottom support surface, wherein the tray includes a main tray that is fixedly attached to the housing and a secondary tray that is supported by the main tray, the secondary tray being separate from the main tray and being freely removable from the main tray and the housing.

2. The dispenser of claim 1, wherein the housing includes a main housing body for mounting to a surface and a door that is pivotably attached to the main housing body and is positionable between an open position and a closed position, the tray being detachably coupled to the main housing body.

3. The dispenser of claim 2, wherein the main housing body has a first funnel-shaped outlet portion along a bottom floor thereof and the door has a second funnel-shaped outlet portion along a bottom floor thereof such that when the door is in the closed position, the first and second funnel-shaped outlet portions abut one another to define the outlet portion which is in the form of a funnel-shaped outlet that has an exit opening in communication with the outlet opening of the tray.

4. The dispenser of claim 2, wherein the tray is snap-fittingly attached to a rear wall of the main housing.

5. The dispenser of claim 1, wherein at least one of the main tray and the secondary tray has a sloped surface.

6. The dispenser of claim 5, wherein the slope comprises a negative slope as measured radially outward from a center portion to an outer peripheral edge.

7. The dispenser of claim 6, wherein the center portion forms an entrance into the outlet opening which is in the form of a funnel-shaped outlet and the outer peripheral edge comprises an annular shaped vertical wall.

8. The dispenser of claim 1, wherein the secondary tray has a bottom support surface on which the roll rests, the bottom support surface having a negative slope as measured radially outward from a center portion to an outer peripheral edge thereof, the center portion containing a center opening that is in fluid communication with the outlet opening that is associated with the main tray.

9. The dispenser of claim 8, wherein the secondary tray has an annular shaped vertical wall extending about an outer perimeter edge of the bottom support surface, the vertical wall containing a lip which rests on an upper edge of a wall of the main tray so as to support the secondary tray above the main tray, with the center opening and the outlet opening being axially aligned.

10. The dispenser of claim 9, wherein an inner section of the bottom support surface of the secondary tray that borders and defines the center opening has an increased thickness compared to the rest of the bottom support surface.

11. The dispenser of claim 8, wherein the roll has a vertical axis passing through a center of the roll which is coreless, with a lead sheet of web material being removed from the coreless center to be fed to the tray, the orientation of the roll causing any fluid within the airlaid web that is pulled downward toward the bottom support surface due to gravitational forces, wherein the sloped nature of the bottom support surface directs the fluid radially outward from the center portion to an outer peripheral edge to prevent the fluid from dripping out of the center opening and the outlet opening of the underlying main tray.

12. A center-pull bottom feed dispenser comprising:

a housing defining a compartment and including a center-pull bottom feed arrangement for dispensing a sheet material, the compartment capable of enclosing a roll of the sheet material which comprises a pre-moistened air-laid web; and a tray disposed in a lower portion of the compartment, the tray capable of supporting the roll, the tray including an outlet opening through which the airlaid web is fed to be accessible to a user, the tray further including a moisture retaining feature that directs fluid from the pre-moistened air-laid web away from the outlet opening and toward an outer peripheral edge of the roll, wherein the tray includes a bottom support surface on which the roll rests and the moisture retaining feature comprises a negative slope in the bottom support surface as measured radially outward from a center portion to an outer peripheral edge of the tray, the roll being orientated on the bottom support surface so that any fluid, within the airlaid web, that is pulled downward by gravitational forces toward the bottom support surface thereupon flows radially outward from the center portion toward the outer peripheral edge to prevent the fluid from dripping out of the outlet opening and to make the fluid available for reabsorption into the airlaid web material, wherein the tray includes a main tray that is fixedly attached to the housing and a secondary tray that is supported by the main tray, the secondary tray being separate from the main tray and being freely removable from the main tray and the housing.

13. The dispenser of claim 12, wherein the housing includes a main housing body for mounting to a surface and a door that is pivotably attached to the main housing body and is positionable between an open position and a closed position, the tray being detachably coupled to the main housing body.

14. The dispenser of claim 13, wherein the main housing body has a first funnel-shaped outlet portion along a bottom floor thereof and the door has a second funnel-shaped outlet portion along a bottom floor thereof such that when the door is in the closed position, the first and second funnel-shaped outlet portions abut one another to define the outlet portion which is in the form of a funnel-shaped outlet that has an exit opening in communication with the outlet opening of the tray.

15. The dispenser of claim 13, wherein the tray is snap-fittingly attached to a rear wall of the main housing.

16. The dispenser of claim 12, wherein at least one of the main tray and the secondary tray has a sloped surface.

17. The dispenser of claim 16, wherein the slope comprises a negative slope as measured radially outward from a center portion to an outer peripheral edge.

18. The dispenser of claim 17, wherein the center portion forms an entrance into the outlet opening which is in the form of a funnel-shaped outlet and the outer peripheral edge comprises an annular shaped vertical wall.

19. The dispenser of claim 12, wherein the secondary tray has a bottom support surface on which the roll rests, the bottom support surface having a negative slope as measured radially outward from a center portion to an outer peripheral edge thereof, the center portion containing a center opening that is in fluid communication with the outlet opening that is associated with the main tray.

20. The dispenser of claim 19, wherein the secondary tray has an annular shaped vertical wall extending about an outer perimeter edge of the bottom support surface, the vertical wall containing a lip which rests on an upper edge of a wall of the main tray so as to support the secondary tray above the main tray, with the center opening and the outlet opening being axially aligned.

21. The dispenser of claim 20, wherein an inner section of the bottom support surface of the secondary tray that borders and defines the center opening has an increased thickness compared to the rest of the bottom support surface.

22. The dispenser of claim 19, wherein the roll has a vertical axis passing through a center of the roll which is coreless, with a lead sheet of web material being removed from the coreless center to be fed to the tray, the orientation of the roll causing any fluid within the airlaid web that is pulled downward toward the bottom support surface due to gravitational forces, wherein the sloped nature of the bottom support surface directs the fluid radially outward from the center portion to an outer peripheral edge to prevent the fluid from dripping out of the center opening and the outlet opening of the underlying main tray.

23. A center-pull bottom feed dispenser comprising:

a housing defining a compartment and including a center-pull bottom feed arrangement for dispensing a sheet material, the compartment capable of enclosing a roll of the sheet material which comprises a pre-moistened air-laid web; and a tray disposed in a lower portion of the compartment, the tray capable of supporting the roll, the tray including an outlet opening through which the airlaid web is fed to be accessible to a user, the tray further including a moisture retaining feature that directs fluid from the pre-moistened air-laid web away from the outlet opening and toward an outer peripheral edge of the roll to promote reabsorption thereby, wherein the tray includes a main tray that is fixedly attached to the housing and a secondary tray that is supported by the main tray, the secondary tray being separate from the main tray and being freely removable from the main tray and the housing, wherein at least one of the main tray and the secondary tray has a sloped surface, wherein the slope comprises a negative slope as measured radially outward from a center portion to an outer peripheral edge, and wherein the center portion forms an entrance into the outlet opening which is in the form of a funnel-shaped outlet and the outer peripheral edge comprises an annular shaped vertical wall.

24. The dispenser of claim 23, wherein the housing includes a main housing body for mounting to a surface and a door that is pivotably attached to the main housing body and is positionable between an open position and a closed position, the tray being detachably coupled to the main housing body.

25. The dispenser of claim 24, wherein the main housing body has a first funnel-shaped outlet portion along a bottom floor thereof and the door has a second funnel-shaped outlet portion along a bottom floor thereof such that when the door is in the closed position, the first and second funnel-shaped outlet portions abut one another to define the outlet portion which is in the form of a funnel-shaped outlet that has an exit opening in communication with the outlet opening of the tray.

26. The dispenser of claim 24, wherein the tray is snap-fittingly attached to a rear wall of the main housing.

27. A center-pull bottom feed dispenser comprising:

a housing defining a compartment and including a center-pull bottom feed arrangement for dispensing a sheet material, the compartment capable of enclosing a roll of the sheet material which comprises a pre-moistened air-laid web; and a tray disposed in a lower portion of the compartment, the tray capable of supporting the roll, the tray including an outlet opening through which the airlaid web is fed to be accessible to a user, the tray further including a moisture retaining feature that directs fluid from the pre-moistened air-laid web away from the outlet opening and toward an outer peripheral edge of the roll to promote reabsorption thereby, wherein the tray includes a main tray that is fixedly attached to the housing and a secondary tray that is supported by the main tray, the secondary tray being separate from the main tray and being freely removable from the main tray and the housing, wherein the secondary tray has a bottom support surface on which the roll rests, the bottom support surface having a negative slope as measured radially outward from a center portion to an outer peripheral edge thereof, the center portion containing a center opening that is in fluid communication with the outlet opening that is associated with the main tray.

28. The dispenser of claim 27, wherein the secondary tray has an annular shaped vertical wall extending about an outer perimeter edge of the bottom support surface, the vertical wall containing a lip which rests on an upper edge of a wall of the main tray so as to support the secondary tray above the main tray, with the center opening and the outlet opening being axially aligned.

29. The dispenser of claim 27, wherein an inner section of the bottom support surface of the secondary tray that borders and defines the center opening has an increased thickness compared to the rest of the bottom support surface.

30. The dispenser of claim 27, wherein the roll has a vertical axis passing through a center of the roll which is coreless, with a lead sheet of web material being removed from the coreless center to be fed to the tray, the orientation of the roll causing any fluid within the airlaid web that is pulled downward toward the bottom support surface due to gravitational forces, wherein the sloped nature of the bottom support surface directs the fluid radially outward from the center portion to an outer peripheral edge to prevent the fluid from dripping out of the center opening and the outlet opening of the underlying main tray.

31. The dispenser of claim 27, wherein the housing includes a main housing body for mounting to a surface and a door that is pivotably attached to the main housing body and is positionable between an open position and a closed position, the tray being detachably coupled to the main housing body.

32. The dispenser of claim 31, wherein the main housing body has a first funnel-shaped outlet portion along a bottom floor thereof and the door has a second funnel-shaped outlet portion along a bottom floor thereof such that when the door is in the closed position, the first and second funnel-shaped outlet portions abut one another to define the outlet portion which is in the form of a funnel-shaped outlet that has an exit opening in communication with the outlet opening of the tray.

33. The dispenser of claim 31, wherein the tray is snap-fittingly attached to a rear wall of the main housing.

* * * * *